US008813404B2

(12) United States Patent
Goppion

(10) Patent No.: US 8,813,404 B2
(45) Date of Patent: Aug. 26, 2014

(54) WINDOW UNIT FOR DISPLAY, PROTECTION AND PREVENTIVE CONSERVATION OF AN OBJECT OF LIMITED THICKNESS

(75) Inventor: Alessandro Goppion, Milan (IT)

(73) Assignee: Goppion S.p.A., Trezzano Sul Naviglio (IT)

( * ) Notice: Subject to any disclaimer, the term of this patent is extended or adjusted under 35 U.S.C. 154(b) by 0 days.

(21) Appl. No.: 11/793,852

(22) PCT Filed: Dec. 24, 2004

(86) PCT No.: PCT/IT2004/000725

§ 371 (c)(1),
(2), (4) Date: Oct. 23, 2007

(87) PCT Pub. No.: WO2006/067815

PCT Pub. Date: Jun. 29, 2006

(65) Prior Publication Data

US 2008/0098638 A1 May 1, 2008

(51) Int. Cl.

| | |
|---|---|
| ***A47G 1/06*** | (2006.01) |
| ***G09F 7/00*** | (2006.01) |
| ***A47B 67/02*** | (2006.01) |
| ***A47G 1/00*** | (2006.01) |

(52) U.S. Cl.

USPC ..... 40/800; 40/726; 40/721; 40/724; 40/611.04; 40/611.03; 40/606.18; 40/572; 312/245; 312/248; 312/242; 312/310; 312/225; 312/226; 312/227

(58) Field of Classification Search

USPC ..... 40/800, 726, 721, 724, 725, 611.04, 40/611.03, 606.18, 572; 312/245, 248, 312/242, 310, 225–227

See application file for complete search history.

(56) References Cited

U.S. PATENT DOCUMENTS 2,649,799 A * 8/1953 Spertus ..... 40/721
3,079,771 A * 3/1963 Donle ..... 63/19

(Continued)

FOREIGN PATENT DOCUMENTS

DE 298 16 309 12/1998
DE 29816309 12/1998

(Continued)

OTHER PUBLICATIONS

PCT International Search Report for PCT/IT2004/000725 filed on Dec. 24, 2004 in the name of Goppion S.P.A.

(Continued)

*Primary Examiner* — Syed A Islam
(74) *Attorney, Agent, or Firm* — Steinfl & Bruno LLP

(57) ABSTRACT

The invention concerns a window unit for display, protection and preventive conservation of an object of limited thickness, in particular a work of art such as a painting, a bas-relief, a tapestry or similar. It comprises a case with a back (32) and a front door (31) coupled together so as to be able to have the case (30) take up an open state, in which the object (D) is not protected and can be inserted into or removed from the case (30), and a closed state, in which the object (D) is protected and can neither be inserted into nor removed from the case (30), in which the front door (31) is provided with a transparent front panel (48) through which the object (D) is visibilé from the front in the state with the case (30) closed. The window unit is characterized in that the back (32) is provided with a transparent rear panel (50) through which the object (D) is visibile from the rear in the state with the ease (30) closed.

14 Claims, 6 Drawing Sheets

(56) References Cited

U.S. PATENT DOCUMENTS

| | | | | |
|---|---|---|---|---|
| 3,140,134 | A * | 7/1964 | Nairn | 312/204 |
| 4,736,538 | A * | 4/1988 | Pierce et al. | 40/779 |
| 5,048,209 | A * | 9/1991 | Ackeret | 40/511 |
| 5,277,949 | A | 1/1994 | Green | |
| 5,283,967 | A * | 2/1994 | Abrams | 40/779 |
| 5,344,015 | A | 9/1994 | Carlin et al. | |
| 6,132,283 | A * | 10/2000 | O'Donnell et al. | 446/227 |
| 7,216,448 | B2 * | 5/2007 | Hsu | 40/725 |
| 7,305,781 | B1 | 12/2007 | Mowry | 40/124.5 |
| 2002/0078613 | A1 | 6/2002 | Roberts et al. | |
| 2005/0022433 | A1 * | 2/2005 | Regelin | 40/124.5 |
| 2005/0044764 | A1 * | 3/2005 | Decker | 40/645 |

FOREIGN PATENT DOCUMENTS

| | | |
|---|---|---|
| DE | 202 01 302 | 4/2002 |
| DE | 20201302 | 4/2002 |

OTHER PUBLICATIONS

PCT International Preliminary Report on Patentability for PCT/IT2004/000725 filed on Dec. 24, 2004 in the name of Goppion S.P.A.

* cited by examiner

WINDOW UNIT FOR DISPLAY, PROTECTION AND PREVENTIVE CONSERVATION OF AN OBJECT OF LIMITED THICKNESS

The present invention concerns a window unit for display, protection and preventive conservation of an object of limited thickness, in particular a work of art such as a painting, a bas-relief, a tapestry or similar.

Normally works of art of limited thickness have a front side where the work of art itself can be seen, whereas the rear side has just the support material on which the work of art has been made, for example the canvas or the board on which a painting has been painted. For display and presentation to the public, therefore, such a work is normally hung on a wall, with just the front side visible.

When a work of art of this type must not only be displayed but also protected, both from attempts at theft and from atmospheric agents that are potentially harmful to the integrity of the work itself, a case is normally used inside which the work is locked. The case containing the work is in turn hung on the wall. Normally, only authorised and qualified personnel are entitled to remove or open the case, acting on suitable mechanical or electronic key-activated locking means.

Above all for particularly delicate or precious works of art, closing it in a base allows the work itself to be kept not only out of reach of thieves, but above all in a predetermined stabilised atmosphere, thus ensuring the best conditions for conservation.

Checking the state of conservation of a work of art is the responsibility of specialised personnel, who for such a purpose periodically inspect the work, possibly also removing it from the case.

The problem forming the basis of the present invention is that of allowing greater possibility of inspection of objects such as works of art without the object itself having to be removed from the window.

The present invention therefore concerns a window unit according to claim 1; preferred characteristics are outlined in the dependent claims.

In particular, the invention concerns a window unit for display, protection and preventive conservation of an object of limited thickness, including a case comprising a back and a front door coupled together so as to be able to have the case take up an open state, in which the object is not protected and can be inserted into or removed from the case, and a closed state, in which the object is protected and can neither be inserted into nor removed from the case, in which the front door is provided with a transparent front panel through which the object is visibile at the front when the case is in closed state, characterised in that the back is provided with a transparent rear panel through which the object is visibile from the rear when the case is in closed state.

The visual inspection of the rear side of the object is normally necessary on particularly delicate works of art, in which the conditions of the support can easily be subject to deterioration through time, with the risk of causing even serious damage to the work of art. On the other hand, if the work of art is held in a conventional case, this very same inspection operation requires that the work of art is removed from the case and therefore subjects the work of art to a greater risk of deterioration, because due to the inspection itself the work is removed—even if temporarily—from its controlled atmosphere and exposed to the external atmosphere and therefore undergoes a potentially dangerous thermo-hygrometric jump. The person responsible for conservation, therefore, has the extremely delicate task of establishing whether and when it is appropriate to remove a work from the case, knowing that to carry out such an operation too often means exposing the work to a greater atmospheric attack, whereas carrying it out too rarely means risking that a dangerous situation for conservation is recognised too late.

The possibility given by the invention of visually inspecting the rear side of an object without having to remove it from the case in which it is held and protected thus allows very frequent checks of the conservation conditions of the object's support to be maintained without having to subject the object to potentially dangerous atmospheric conditions in order to do so. This type of inspection is particularly important and useful on antique works of art made on supports made from a material that can easily alter and actually are already altered over the course of time; this is the case, for example, of paintings or bas-reliefs made on wooden boards.

Preferably, the window unit comprises a support structure, intended to be fixed to a wall and coupled with the case, at at least one of the back and the front door, so as to be able to have the case take up a position close to the wall and a position away from the wall. In such a way, it is possible to inspect the rear side of the object held in the case not only without the object having to be removed from the case, but without it even being necessary to completely remove the case from the wall; this is very advantageous for works, and consequently cases, that are very large and therefore very heavy, but it is extremely useful in any case because it eases and speeds up the inspection operations, actually making it possible to have much more frequent inspections with the same available resources.

The back and the front door can be coupled together in various ways, so as to allow or not allow the door to be completely detached from the back. Preferably, unless special conditions require the possibility of completely detaching the door from the back, the back and the front door are coupled together by a hinge; this coupling is, indeed, simple to carry out and easy and quick to use. The axis of such a hinged coupling can be either vertical, extending along the side of the window unit, or horizontal, extending along the top of the window unit.

Preferably, the support structure is hinged both to the back and to the front door, a single hinging pin being provided to provide the hinging between the back, the front door and the support structure. This configuration makes both the displacement operations of the closed case from the position close to the wall to the position away from the wall and the opening and closing operations of the case particularly convenient, easy and quick. This last aspect is particularly important not so much in normal use of the window, since normally the case does not have to be opened to allow inspection, but rather in emergency situations in which it is of vital importance to remove the work of art as quickly as possible to avoid it suffering damage from exceptional situations such as fires, floods, collapsing, bombing or similar.

Preferably, the support structure comprises a frame intended to be fixed to the wall through fastening members accessible only when the case is in position away from the wall. The possibility of the entire window being removed from the wall is thus avoided unless the case has already been brought in position away from the wall.

More preferably the case is such as to be opened and closed only when it is away from the wall.

In such a way it is possible to protect the object from theft by simply providing primary closing means, preferably key-operated, to lock the case in position close to the wall, thus preventing both the removal of the window from the wall, and the opening of the case.

Preferably, the window unit also comprises secondary closing means for locking the case in closed state. These means avoid the case being able to be opened accidentally in the displacement operations of the case from the position close to the wall to the position away from the wall; such means do not necessarily have to involve a key if the primary locking meas already involve the use of a key.

Further characteristics and advantages of a window unit according to the invention shall become clearer from the following detailed description of a preferred embodiment thereof, made with reference to the attached drawings. In such drawings.

Figure 1:
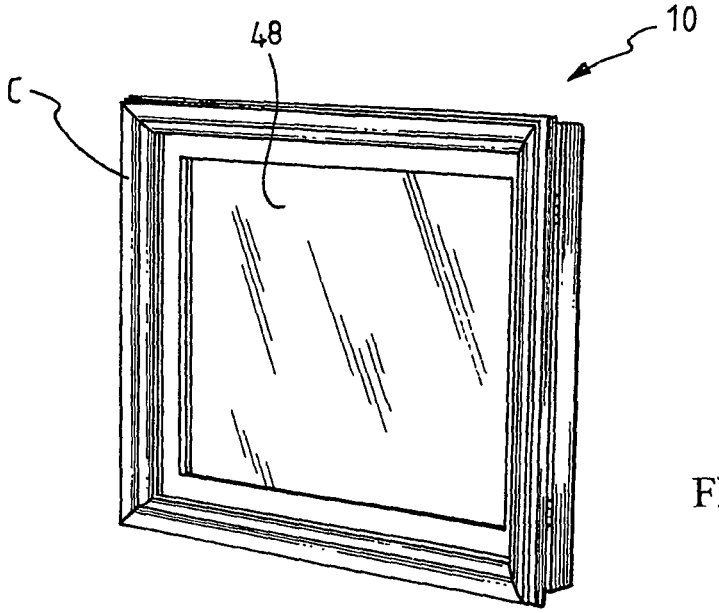
FIGS. 1, 2 and 3 are, respectively, a perspective view, a view from above and a horizontal section view of a window unit according to the invention, with the case in closed state and in position near to the wall.
Figure 2:
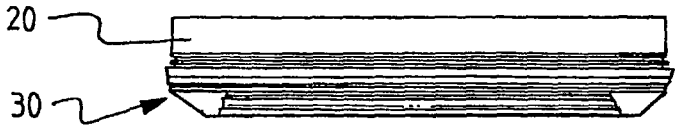
Figure 3:
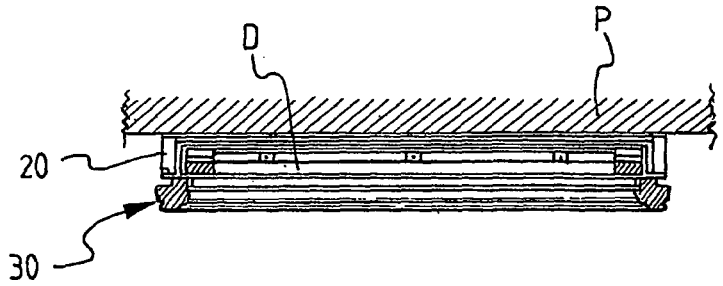
Figure 4:
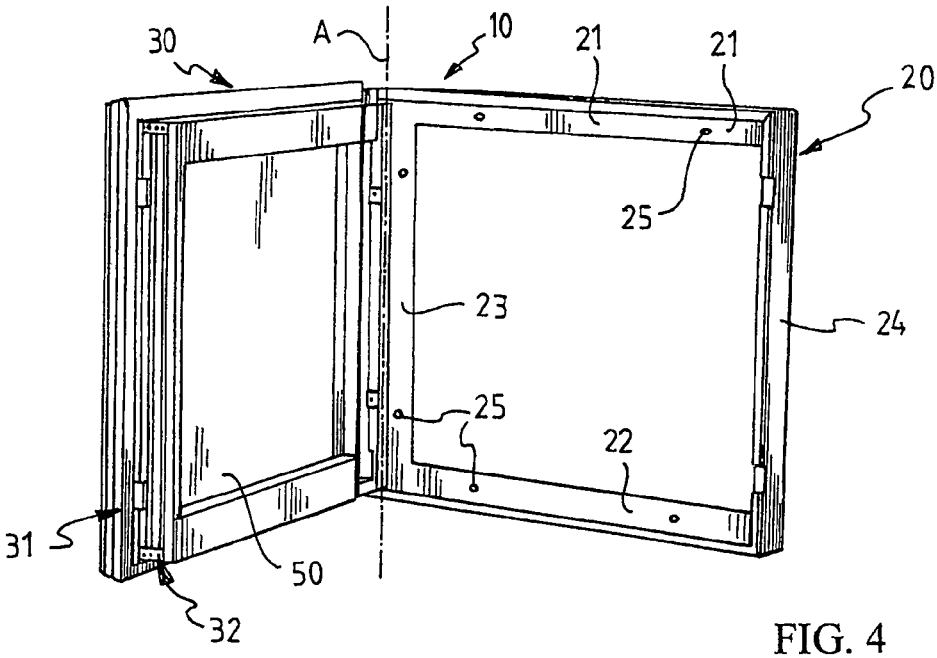
FIGS. 4, 5 and 6 are, respectively, a perspective view, a view from above and a horizontal section view of the window unit of FIGS. 1, 2 and 3, with the case in closed state and in position away from the wall.
Figure 5:
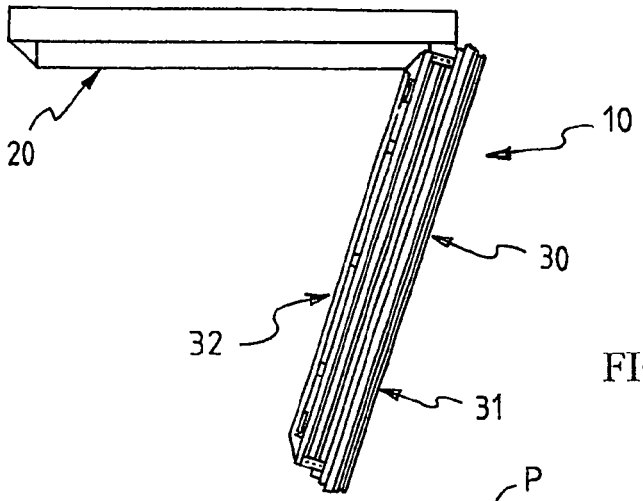
Figure 6:
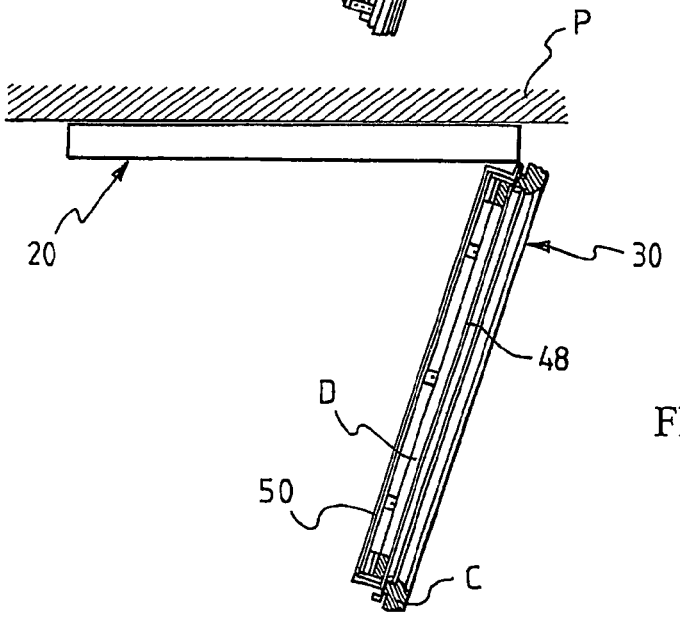
Figure 7:
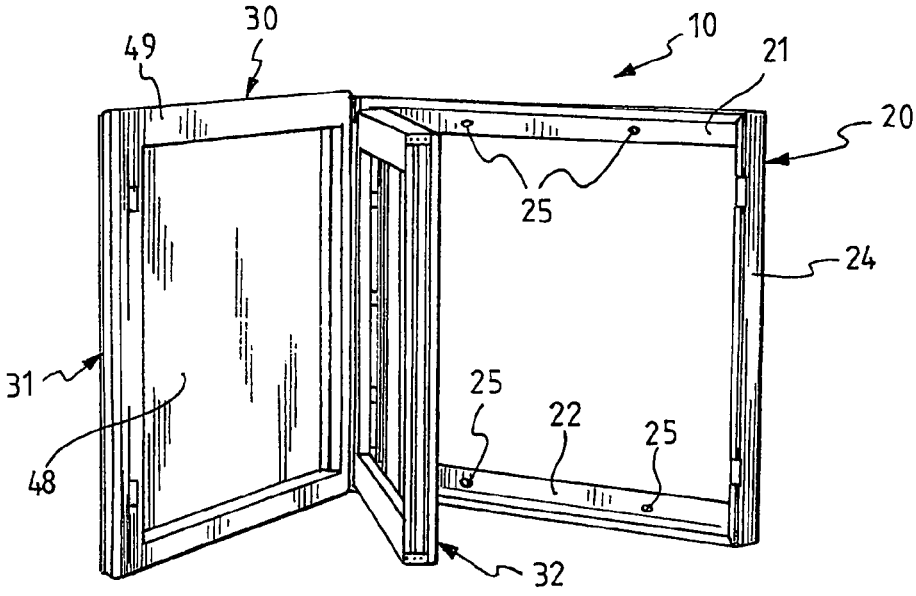
FIGS. 7, 8 and 9 are, respectively, a perspective view, a view from above and a horizontal section view of the window unit of FIGS. 1, 2 and 3, with the case in open state and in position away from the wall.

In the figures, a window unit for display, protection and preventive conservation of an object of limited thickness such as a painting D, in accordance with an embodiment of the invention is globally indicated with 10. The window unit 10 comprises a support structure 20 for fixing the window unit 10 to a wall P and a case 30 carried by the support structure 20.

The support structure 20 is formed from a frame formed from two cross-members 21 and 22 and two uprights 23 and 24, all integral with each other and provided with holes 25 for fixing to the wall P through screws (not shown).

The upright 23 is provided with a plurality of hinges or hinge elements 27, aligned along a substantially vertical axis A and spaced apart. Each hinge 27 comprises a base 28, fixed to the upright 23, and two eyelets 29; along the axis A, at each hinge 27, five portions are defined extending axially for the same length E: two portions each occupied by one of the two eyelets 29 and three free portions, alternating with the two portions occupied by the eyelets 29. In a non-shown variant of the invention, the hinging axis can be arranged horizontally, along the upper edge of the case 30.

Figure 8:
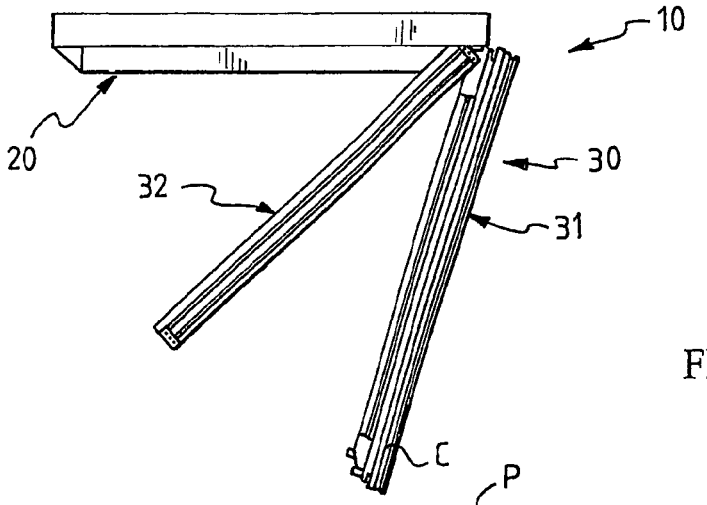
Figure 9:
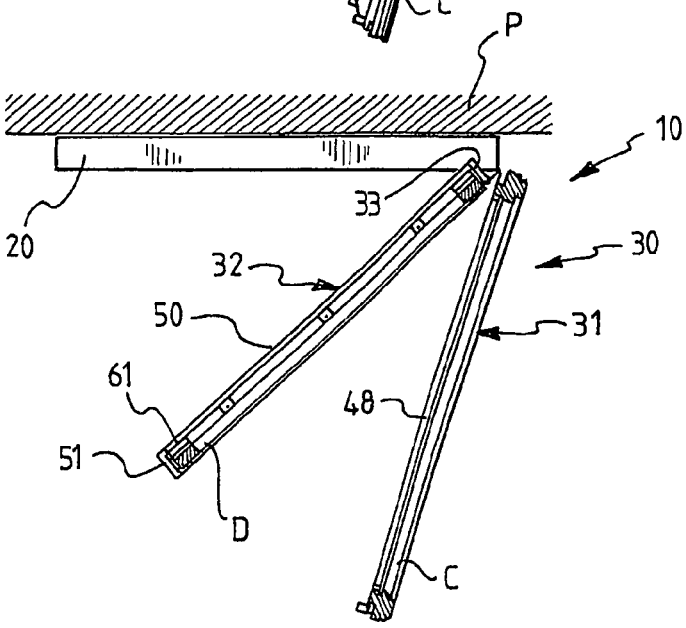
Figure 10:
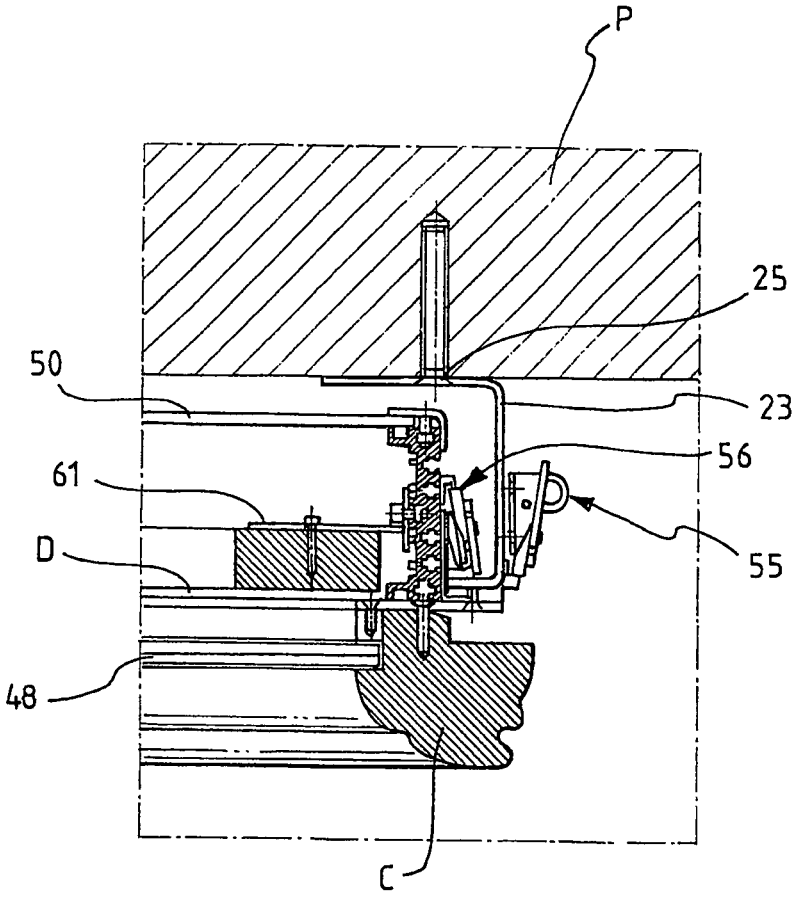
FIG. 10 is a horizontal section view of a first detail of the case of the previous figures, with the case in closed state and in position near to the wall.
Figure 11A:
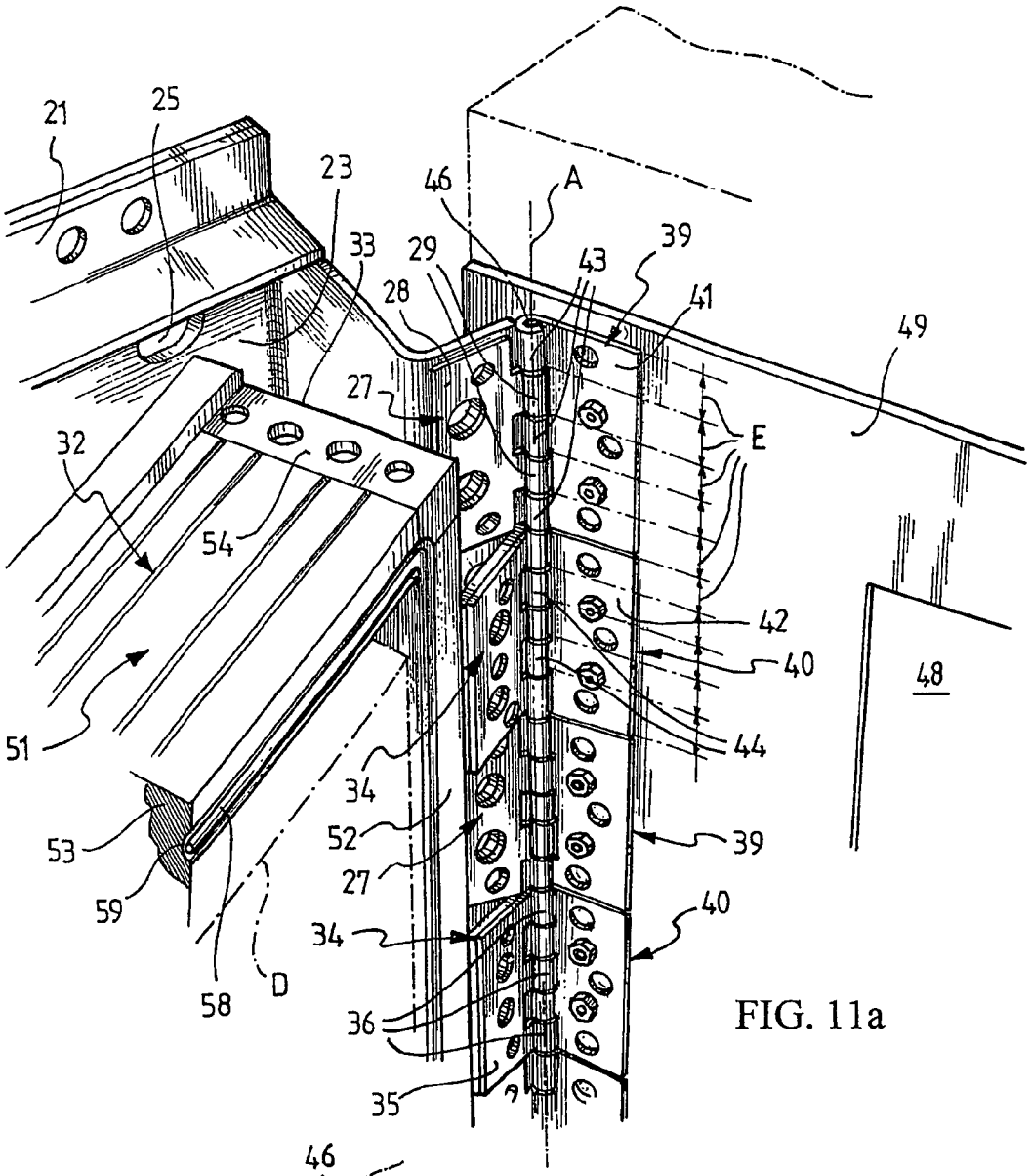
FIG. 11 is a perspective view of another detail of the case of the previous figures, with the case in open state and in position away from the wall.
Figure 11B:
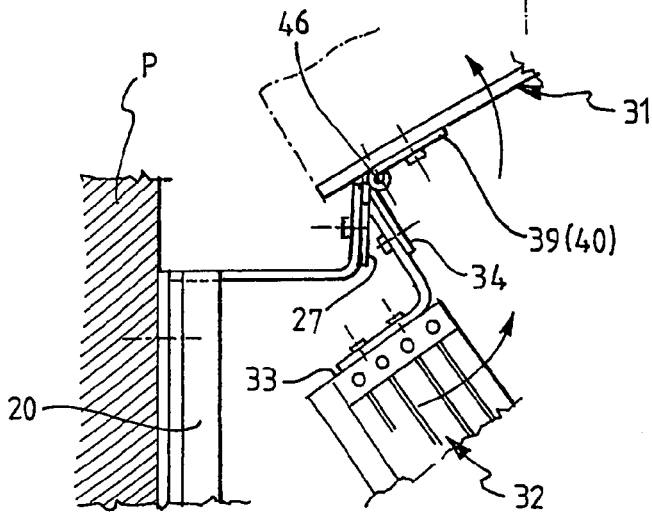
Figure 12B:
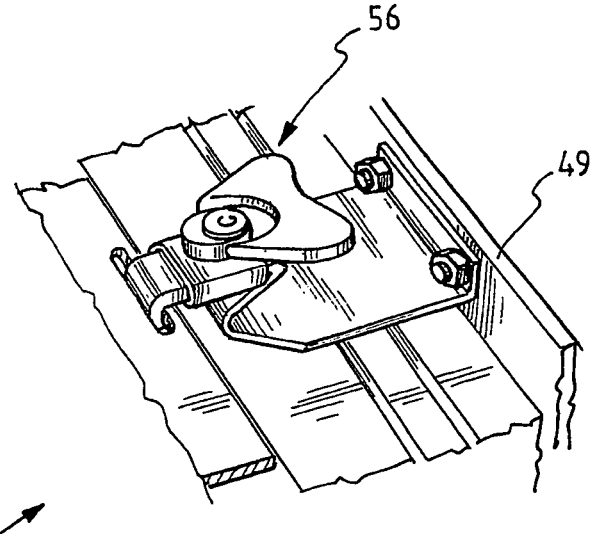
FIG. 12 is a perspective view of another detail of the case of the previous figures, with the case in closed state and in position near to the wall.
Figure 12A:
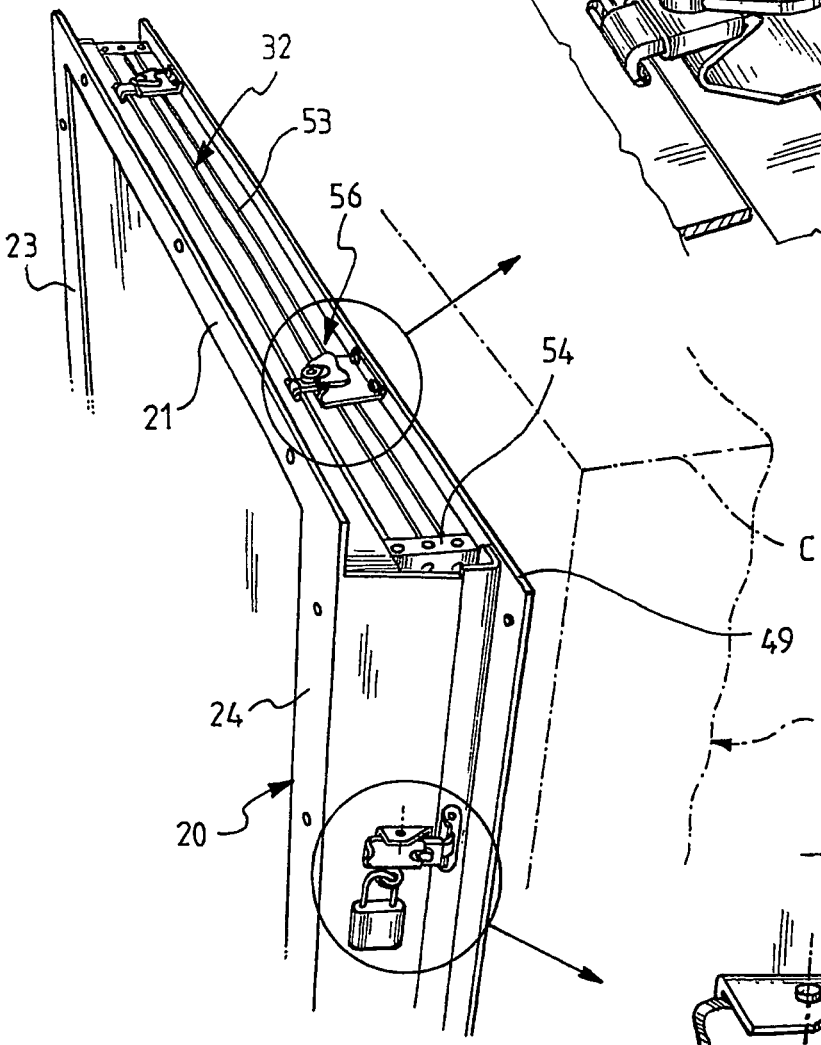
Figure 12C:
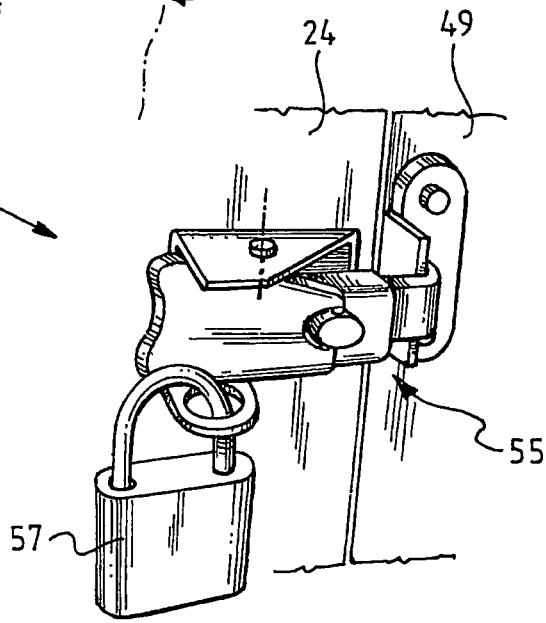

The case 30 comprises two half-cases, a front one 31 or front door and a rear one 32 or back. The two half-cases 31 and 32 are coupled together in such a way that they can open, so as to be able to have the case 30 take up an open state (see, in particular, FIGS. 8, 9, 11), in which the painting D is not protected and can be inserted into the case 30 or removed from it, and a closed state, in which the painting D is protected and can neither be inserted into the case 30 nor removed from it.

For such a purpose, the back 32 is provided, along a vertical side 33 thereof, with a plurality of hinges or hinge elements 34, aligned along the axis A and spaced apart. Each hinge 34 comprises a base 35 and three eyelets 36; along the axis A, at each hinge 34, five portions are defined extending axially and for the same length E: three portions each occupied by one of the three eyelets 36 and two free portions, alternating with the three portions occupied by the eyelets 36.

In the same way, the front door 31 is provided, along a vertical side 38 thereof, with a plurality of hinges or hinge elements 39 and 40, aligned and alternating along the axis A, brought close together in succession. Each hinge 39 comprises a base 41 and three eyelets 43; along the axis A, at each hinge 39, five portions are defined that extend axially and for the same length E: three portions each occupied by one of the three eyelets 43 and two free portions, alternating with the three portions occupied by the eyelets 43. Each hinge 40 comprises a base 42 and two eyelets 44; along the axis A, at each hinge 40, five portions are defined that extend axially and for the same length E: two portions each occupied by one of the two eyelets 44 and three free portions, alternating with the two portions occupied by the eyelets 44.

A pin 46 is provided along the axis A, rotatably inserted in each of the eyelets 29, 36, 43, 44 of the hinges 27, 34, 39, 40. The extension and configuration of the hinges 27, 34, 39, 40 and in particular of the respective eyelets 29, 36, 43, 44 along the axis A are such that each portion with axial extension E along the axis A is covered by one and only one of such eyelets, substantially adjacent to two other eyelets, so that the assembly of the hinges 27, 34, 39, 40 and of the pin 46 forms a hinge coupling both between the back 32 and the door 31, and between each of them and the support structure 20.

The door 31 comprises a transparent panel 48 mounted on a perimetric frame 49, to which frame 49 the bases 41 and 42 of the hinges 39 and 40 are fixed. The back 32 comprises a transparent panel 50 mounted on a perimetric frame 51, formed from two uprights 52 and two cross-members 53, fixed together integrally by angular blocks 54; the bases 35 of the hinges 34 are fixed to one of the two uprights 52 of the frame 51.

Thanks to the aforementioned hinged coupling, the case 30 can take up two positions, close to or away from the wall P, and two states, closed or open.

In position close to the wall P, the case 30 is substantially adjacent to the support structure 20, whereas in position away from the wall P the case 30 is spaced from the support structure 20.

In closed state, the door 31 and the back 32 are closed against each other, and in such a way access to the inside of the case 30 is prevented, both to insert and to remove the painting D; vice-versa, in open state the door 31 and the back 32 are separated, and in such a way it is possible to access the inside of the case 30, both to insert and to remove the painting D.

The window unit 10 also comprises primary closing means to maintain the position close to the wall and secondary closing means to maintain the closed state.

The primary closing means, to maintain the position close to the wall, comprise key-operated removable primary fastening members 55, mounted and operating between the upright 24 of the support structure 20 and the frame 49 of the front door 31.

The secondary closing means, to maintain the closed state, comprise removable secondary fastening members 56, mounted and operating between the frame 51 of the back 32 and the frame 49 of the door 31.

The removable fastening members 55 and 56 are per se conventional, for example of the dead centre type, and are not described or shown in detail. Of these, the fastening members 55 provide a key-operated control, for example a padlock 57, to allow only authorised personnel to displace the case 30 into position away from the wall; the fastening members 56, on the other hand, do not need key-operated control, since they are accessible and/or usable only with the case 30 in position away from the wall, i.e. after the primary closing means 55 have been opened.

Between the back 32 and the door 31, sealing means are preferably provided, for example a gasket 58 housed in a channel 59 formed on the frame 51, in particular in the uprights 52, in the cross-members 53 and in the angular blocks 54, so as to ensure the insulation of the volume inside the case 30 with respect to the surrounding atmosphere. The atmospheric conditions inside the case 30, in particular the temperature and humidity, are preferably regulated and controlled by a suitable air-conditioning system, according to the painting D (or in any case the object) in the case 30 itself. Such a system can either be of the active type, with a refrigerating cycle unit, or of the passive type, with hygroscopic material such as silica gel; for particularly sophisticated protection, it is also possible for the system to comprise both passive and active components. Of course, should the type and conditions of the object inserted in the case 30 allow it, both the air-conditioning system and the gasket 58 can be omitted.

The painting D can be housed in the case 30 in various ways. In the shown example, the painting D is mounted—without its frame C—on the back 32, preferably through shock-absorbing elastic supports 61. The frame C, on the other hand, is mounted on the front door 31, fixed to the frame 49 on its outside.

In use, the window unit 10 is usually hung on the wall P, with the support structure 20 fixed to such a wall, the case 30 in closed state and close to the wall, and the removable fastening members 55 and 56 closed. The object, for example the painting D, is held and protected in the case 30, visible to the public through the transparent panel 48 but not accessible, due to the closing of the primary and secondary fastening members 55 and 56. In particular, the key-operated locking of the primary fastening members 55 prevents dishonest third parties both from having access to the painting D, and from removing the entire window unit 10 from the wall P; this characteristic is of particular interest for the protection of works of art situated in locations without continuous surveillance, a state in which, for example, most works of art housed in castles, churches or parish churches are kept.

When the person responsible for the conservation of the painting D wants to inspect the back of the painting, he opens the removable primary fastening members 55 and moves the case 30 (kept closed by the secondary fastening members 56) from the position close to the wall to the position away from the wall. He can thus visually inspect the rear of the painting D through the transparent panel 50, without the painting D having to be removed from the case 30 and even without the case 30 having to be opened; thanks to this, the painting D remains in its protected and controlled atmosphere.

In the case in which the visual inspection reveals the need for more in-depth checks, the painting D can be removed by also opening the removable secondary fastening members 56 and opening the case 30. Only in this case, clearly, the painting D is necessarily taken out from its protected and controlled atmosphere.

It should be noted that, thanks to the invention the visual inspection of the back of the painting D can be carried out extremely easily and quickly, without any risk for the painting D itself. This therefore ensures the best preventive conservation conditions of the painting D, because the person responsible can check the painting even very frequently, without the fear of excessive costs or worse risks for the painting D.

Of course, the invention can be carried out in a different way to that of the shown example. For example, the hinging axis A can be arranged horizontally instead of vertically, at the top side of the case of the window unit.

The invention claimed is:

1. Window unit for display, protection and preventive conservation of an object of limited thickness, including:

a case in which the object is locked and protected by a sealing means that ensures insulation of a volume inside the case, the case comprising a back and a front door coupled together so as to be able to have the case take up an open state, in which the object is neither locked nor protected and can be inserted into or removed from the case, and a closed state, in which the object is locked and protected and can neither be inserted into nor removed from the case, in which the front door is provided with a transparent front panel through which the object is visible from the front in the state with the case closed, wherein the back is provided with a transparent rear panel through which a rear side of the object can be visually inspected while the object remains locked and protected within the case in closed state to allow preventive inspection of a state of conservation of the object;

a support structure, comprising a fixing means to fix the support structure to a wall wherein the support structure is coupled to the case by a hinge so as to be able to have the case take up a position close to the wall and a position away from the wall;

a first locking mechanism to allow locking the case in its position close to the wall; and a second locking mechanism to allow locking the case in its closed state, wherein at least one of the first and second locking mechanisms is releasable from a locked position through a key.

2. Window unit according to claim 1, wherein the back door, the front door, and the support structure are coupled together by the hinge.

3. Window unit according to claim 2, wherein the hinge comprises a single hinging pin.

4. Window unit according to claim 3, wherein the support structure comprises a frame intended to be fixed to the wall through fastening members accessible only when the case is in position away from the wall.

5. Window unit according to claim 4, wherein the case is such as to only be opened and closed when it is in position away from the wall.

6. Window unit according to claim 5, comprising elastic suspension means of the object inside the case.

7. Window unit according to claim 5, wherein the volume inside the case is connected to an air-conditioning system.

8. Window unit according to claim 5, wherein the volume inside the case is regulated and controlled with a hygroscopic material.

9. Window unit according to claim 5 wherein the front door comprises a plurality of hinge elements.

10. Window unit according to claim 9 wherein each hinge element of the front door comprises a base fixed to the door and three eyelets and each hinge element is divided into five portions, three portions each occupied by one of the three eyelets and two free portions, alternating with three portions occupied by the eyelets.

11. Window unit according to claim 9 wherein the back door comprises a plurality of hinge elements.

12. Window unit according to claim 10 wherein the back door comprises a plurality of hinge elements each hinge element of the back door comprising a base and three eyelets and each hinge element divided into five portions, three portions each occupied by one of the three eyelets and two free portions, alternating with the three portions occupied by the eyelets.

13. Window unit according to claim 12 wherein the support structure comprises a plurality of hinge elements, each hinge element comprising a base fixed to the support structure and two eyelets and each hinge element divided into five portions, two portions each occupied by one of the two eyelets and three free portions, alternating with the two portions occupied by the eyelets.

14. Window unit according to claim 5 wherein the sealing means comprise a gasket housed in a channel.

* * * * *